United States Patent [19]

Stoveken

[11] 4,307,829

[45] Dec. 29, 1981

[54] PAPER CUTTING APPARATUS

[75] Inventor: F. Raymond Stoveken, East Windsor, N.J.

[73] Assignee: Marcal Paper Mills, Inc., Elmwood Park, N.J.

[21] Appl. No.: 82,084

[22] Filed: Oct. 5, 1979

[51] Int. Cl.[3] ..... B26D 1/02

[52] U.S. Cl. ..... 225/67; 225/73

[58] Field of Search ..... 225/67, 73, 74, 72, 225/85, 84, 77, 71

[56] References Cited

U.S. PATENT DOCUMENTS

| | | | |
|---|---|---|---|
| 408,752 | 8/1889 | Ross | 225/73 X |
| 423,798 | 3/1890 | Nentrup | 225/71 |
| 423,810 | 3/1890 | Rabich | 225/71 |
| 424,788 | 4/1890 | Hubbell | 225/73 X |
| 432,107 | 7/1890 | Yarger | 225/85 X |
| 451,685 | 5/1891 | Tracy | 225/71 |
| 648,837 | 5/1900 | Blue | 225/85 X |
| 807,353 | 12/1905 | Bretz | 225/73 X |
| 1,952,374 | 3/1934 | Hill | 225/77 X |

FOREIGN PATENT DOCUMENTS

| | | | |
|---|---|---|---|
| 44852 | 2/1928 | Norway | 225/71 |
| 8538 | 2/1916 | United Kingdom | 225/71 |

*Primary Examiner*—Frank T. Yost

*Attorney, Agent, or Firm*—Burns, Doane, Swecker & Mathis

[57] ABSTRACT

A cutting device for a roll of material wherein a cutter bar with a cutting blade fixed thereto is arranged between two upright posts. To cut the material from the roll a length of material is withdrawn from beneath the cutter bar and lifted against the cutter bar. The cutter bar is allowed to pivot about a longitudinal axis until an upstanding rib and a notch in the cutter bar clamp the upright posts between them and lock the cutter bar against further pivoting motion. The material is then torn across the cutting blade since the cutter bar cannot be further pivoted.

18 Claims, 4 Drawing Figures

FIG. 3
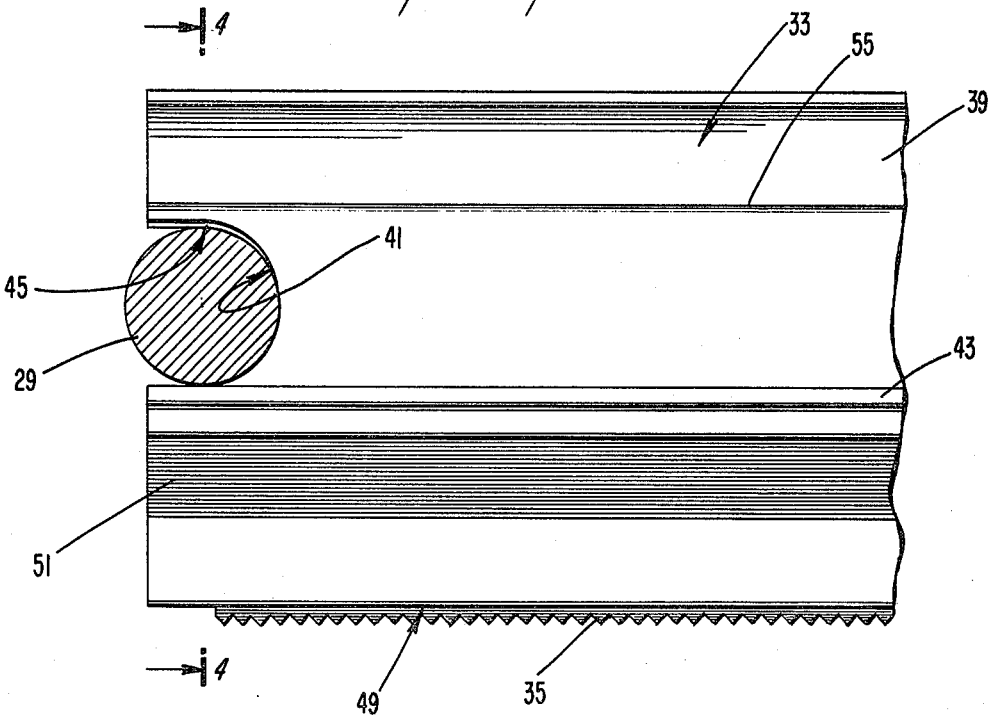
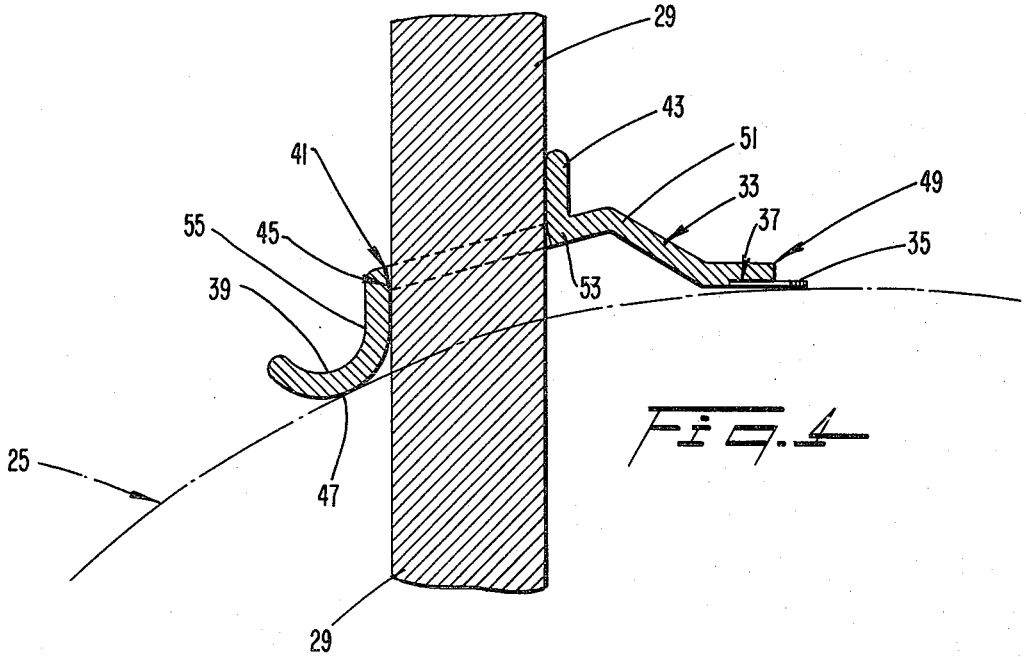
FIG. 4

PAPER CUTTING APPARATUS

BACKGROUND AND SUMMARY OF THE INVENTION

The present invention relates to cutting devices, and more particularly to cutting methods and apparatus for severing sheet material from a roll.

Paper and other materials are conveniently stored in rolls, from which the user can cut or tear off a piece of the desired length. For example, a roll of paper may be mounted on a shaft and a weighted bar is then hingedly mounted on the shaft to allow the user to tear paper from the roll by pulling the paper upwardly against the bar. The bar, however, must be heavy enough to apply sufficient force to tear the paper, because once the bar is raised from the roll, the paper is free to unwrap from the roll and the tearing operation will be uneven or incomplete.

Prior attempts to provide a reliable paper cutting device have produced various devices which were bulky and/or fairly complex. Several of those prior devices required the paper to be threaded from the roll through one or more slots or grooves in the paper cutter in order to tear the paper against a blade. Other mechanisms had bearings upon which the cutter rotated which bearings required lubrication. In general, the known devices of the prior art did not assure a straight, even cut of the paper, particularly when the paper roll was out of round or had diminished appreciably in diameter due to the withdrawal of a large quantity of paper from the roll.

One such known device is disclosed in U.S. Pat. No. 423,228 issued on Mar. 11, 1890 to Ellerman and includes a roll paper holder and cutter including a bulky gravity bar. The gravity bar is carried on a pair of parallel standards provided on either side of the roll of paper. A cutting bar is carried ahead of the paper roll. To tear the paper with the Ellerman device, the paper is pulled against the stationary cutting bar, which bar is apparently not permitted to tilt about the pair of parallel standards.

Another known cutting device is disclosed in U.S. Pat. No. 2,655,214 issued on Oct. 13, 1953 to Van Cleef. The Van Cleef device includes a tape cutter member which is constrained to ride along the outer surface of a roll of tape by an elastic member. In order to tear the tape, a portion of the tape cutter member must be manually held against the tape roll. A channel is provided along the rearward edge of the tape cutter member to provide a flat surface against the tape when the cutter is pressed down.

A further example of a known paper cutter is disclosed in U.S. Pat. No. 436,789 issued on Sept. 23, 1890 to Jobes. The Jobes device includes a roll paper cutter having a cutting edge which is pivotably mounted with respect to the roll of paper. In the Jobes device, a number of various stops and adjustments are provided to adapt the cutter to different sized rolls.

A still further example of a known paper cutter may be seen in U.S. Pat. No. 2,234,818, which issued on Mar. 11, 1941 to Bulman. The Bulman paper cutter includes a cutter bar which is firmly held against a roll of paper, even when tearing the paper, by a pair of springs.

Other known cutting devices are disclosed in the following U.S. Pat. Nos.: 1,928,148 issued Sept. 26, 1933 to Bratz; 851,832 issued Apr. 30, 1907 to Patterson; and 389,506 issued Sept. 11, 1888 to Haiman.

Accordingly, it is an object of the present invention to provide a cutting device which is both relatively simple to use and inexpensive to produce.

It is a further object of the present invention to provide a one piece cutter bar which will ride freely along a roll of paper while the paper is being withdrawn from the roll but which will firmly lock in place when the paper is to be cut.

Still a further object of the present invention is to provide a cutting device which is easily installed or removed from an operative position.

Yet another object of the present invention is to provide a cutting device which aids in preventing further rotation of the roll as the paper is torn therefrom.

These and other objects are realized with a paper cutting device according to the present invention wherein an elongate cutter bar is provided with a cutting blade fixed to a leading edge of the cutter bar. An opening is disposed at each end of the cutter bar. Each opening receives an upright post therein. An upstanding projection is provided along the cutter bar to frictionally engage the two upright posts.

According to a further feature of the present invention a paper roll stand is provided to support the paper roll and the upright posts.

According to a preferred embodiment of the present invention, the cutter bar is provided with a curved channel along the trailing edge of the cutter bar to continually contact the paper roll.

According to a further feature of the present invention the openings comprise notches each having a diameter which is slightly larger than the diameter of the upright posts.

In order to tear paper from the roll, a predetermined length of paper is withdrawn and lifted, beginning at one end of the paper roll and continuing along the roll to the other end, against the cutting blade. The upward force applied by the paper pivots the cutter bar about the channel until the upstanding rib and the rear side of the notches clamp the cutter bar about the upright posts. The pivoting motion of the cutter bar also tends to drive the channel into the paper roll to retard the roll from further rotation while the paper is torn. The cutter bar is maintained in constant contact with the paper roll by the force of gravity as the paper is withdrawn from the roll. Even if the paper roll is non-circular, the roll of paper will lift the curved channel along the trailing edge. In this way, the cutter will assume a more tangential attitude on the roll and will permit the cutter to raise or lower on the upright posts as necessary. Of course, when the diameter of the paper roll has decreased sufficiently, the trailing edge of the cutter may extend beyond the roll of paper.

BRIEF DESCRIPTION OF THE DRAWINGS

A preferred embodiment of the present invention is illustrated in the accompanying drawings wherein like members bear like reference numerals and wherein:

FIG. 3 is a view of a portion of the paper cutter bar taken along the line 3—3 of FIG. 1; and FIG. 4 is a view of the paper cutter bar taken along the line 4—4 in FIG. 3.

DETAILED DESCRIPTION OF THE PREFERRED EMBODIMENT

Figure 1:
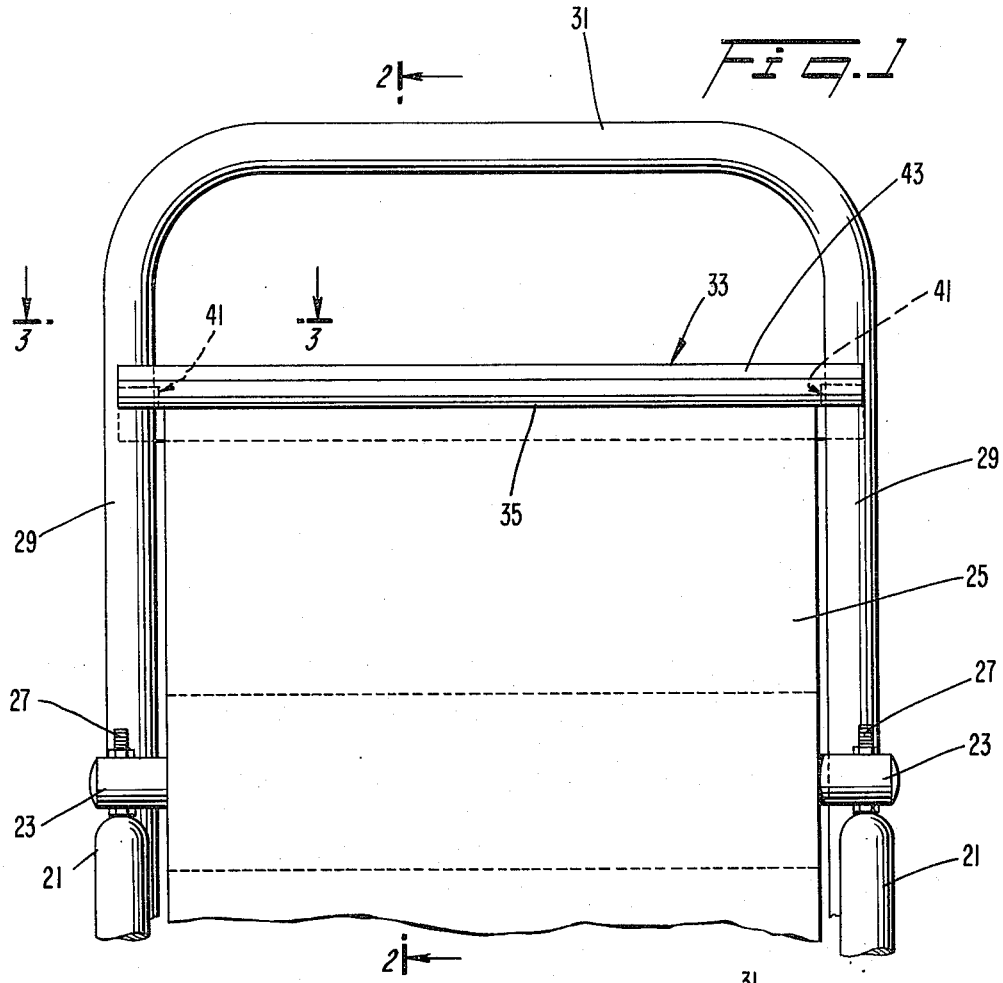
FIG. 1 is a front view of a paper cutting device according to the present invention.
Figure 2:
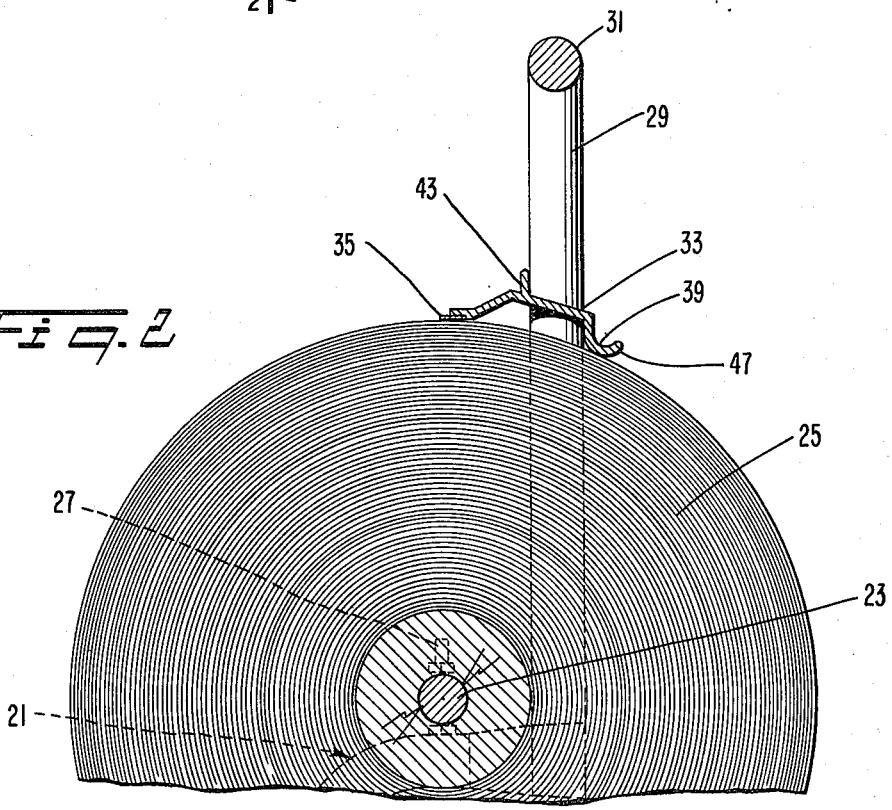
FIG. 2 is a view of the paper cutting device taken along the line 2—2 of FIG. 1.

With reference to FIG. 1, a preferred embodiment of the present invention includes a paper dispenser base 21 (partially shown in FIG. 1) having a rod 23 for supporting a paper roll 25. The base 21 includes a support positioned on the floor to support the paper roll 25 in a free standing state. The base 21 can be of any known construction but should be sufficiently heavy or securely mounted to allow paper to be withdrawn from the paper roll 25 without causing the base 21 to move. The rod 23 is secured to the base 21 with bolts 27. The bolts 27 are removed and the rod 23 is withdrawn when it is necessary to change to a new paper roll 25.

Also secured to the base are two parallel upright posts 29. The upright posts 29 extend vertically upwardly from the base 21 outside of the paper roll 25. In the preferred embodiment, the posts 29 are displaced rearwardly of the paper roll supporting rod 23. The upright posts extend substantially above the top of the paper roll 25 and are joined by a cross member 31. The cross member 31 is provided mainly for stability and to serve as a handle, and could be eliminated if not needed.

A cutter bar 33 is preferably placed between the upright posts 29 with the leading edge disposed towards the supporting rod 23. The cutter bar 33 is adapted to slide vertically along the upright posts 29 to facilitate changing the paper rolls 25 and to adapt to the changing diameter of the paper roll 25 as the paper is withdrawn.

A preferred embodiment of the cutter bar 33 (see FIGS. 3 and 4) may be formed in one piece from extruded aluminum and includes a serrated cutting blade 35 adhesively fixed along a leading edge of the cutter bar in a groove 37 provided in the lower surface of the cutter bar 33. The cutter bar 33 also includes an upwardly curved channel 39 along the trailing edge, opposite the cutting blade, with a curved lower surface 47 provided to ride smoothly upon the paper roll 25. The cutter bar 33 includes first and second notches 41 (see FIGS. 1 and 3) disposed at each end of the cutter bar. An upstanding rib 43 is disposed along an edge of the notches 41 closest to the cutting blade on the upper surface of the cutter bar 33. The upstanding rib 43 preferably extends across the entire length of the cutter bar 33. However, a small upstanding section, slightly longer than the diameter of one upright post 29, could instead be provided at each upright post. The rib 43 is preferably angled slightly towards the cutting blade 35 to compensate for the angle of the cutter bar 33. In this way, the rib 43 rides parallel with the post 29 when paper is not being cut.

As can be seen in the drawings, the diameter of the notches 41 in the cutter bar 29 is slightly larger than the diameter of the cylindrical upright posts 29 to permit a pivotal movement of the cutter bar 33. The notches 41 also include an edge 45 nearest the curved channel 39 the function of which will be explained in detail below. The notches 41 in the preferred embodiment comprise open, substantially cylindrical cutouts. However, it is to be understood that the notches could be closed cylindrical holes drilled into the cutter bar. Alternatively, they could be of a different shape to correspond to the shape of the upright posts 29. The important feature is that the notch or opening which receives the upright posts be of a shape corresponding to the upright posts and just slightly larger than the posts.

The cutter bar 33 of the preferred embodiment is constructed so that the cutting blade 35 rides along the top of the paper roll in a substantially horizontal plane. The leading section 49 of the cutter bar 33 which carries the cutting blade 35 is attached to a straight upper section 53 displaced vertically from the paper roll by an upwardly angled section 51. A further section 55 of the cutter bar is angled slightly towards the trailing edge and connects the straight section 53 with the upwardly curved channel 39. The section 55 is angled such that the plane of the section 55 will be parallel with the upright support 29 when the cutter bar 33 is allowed to move by gravity as the paper roll 25 diminishes in size. By arranging the angles of the section 55 and the upstanding rib 43, so that those features are parallel with the upright posts 29, the cutter bar slides freely along the posts without binding even though the notches 41 are only slightly larger than the diameter of the upright posts 29.

In operation, an end of the paper extending beyond the cutting blade 35 is lifted from one side of the roll 25 to the other, thereby forcing the paper against the blade 35. The upward force applied to the cutting blade 35 is transmitted through the cutter bar 33 causing the cutter bar to pivot about a longitudinal axis colinear with the lower contact surface 47 of the curved channel 39. This pivotal motion causes the upstanding rib 43 to ride slightly upwardly along the upright posts 27 and to frictionally engage the same. The pivoting motion of the bar about the channel 39 also causes the rear edge 45 of the notches 41 to frictionally engage the rear side of the upright posts 29. The cutter bar 33 is thereby locked against further pivotal motion by clamping the upright posts 29 between the upstanding rib 43 and the rear edge 45 of the notches 41. The paper is then easily cut against the now stationary blade 35. Obviously, the procedure outlined above occurs very quickly in actual practice. The angle through which the cutter bar 43 pivots is also very small, i.e., typically less than 5°. However, this angle is sufficient to positively lock the bar since the clearance between the upright posts 29 and the notches 41 is correspondingly small.

The pivotal motion of the cutter bar 33 also forces the lower surface 47 of the curved channel 39 more tightly against the paper roll 25 to act as a brake upon the paper roll 25. In this way, further rotation of the paper roll is retarded while the predetermined length of paper is cut evenly against the cutting blade 35.

The paper cutting device of the present invention assures an even cut as the paper roll diminishes in size. This is so because the present invention provides a paper cutter which rides freely along the upright posts as the paper roll diminishes in size due to the enlarged notches and the angles of both the section along the trailing edge and the upstanding rib.

The present invention further assures straight cuts since the cutter bar only pivots through a very small angle before locking in position against the upright posts. Still another advantage of the cutter bar of the preferred embodiment is that the cutting blade itself is in a generally horizontal plane on the top of the paper roll and therefore the cutter does not bind upon the paper as paper is withdrawn from the roll.

A further advantage of the present invention lies in the ease of operation and the low cost of production. The cutter bar in the present invention can be made in a single piece from extruded aluminum. The cutter bar can be quickly installed or removed by lowering or lifting the bar over the upright posts.

Although this invention is described as useful for cutting paper, it should be recognized that other materials are capable of being severed by the device of this invention. For example, non-woven synthetic materials, composite materials, plastic sheets or films and foils may be severed in accordance with this invention.

The principles and preferred embodiments of the present invention have been described in the foregoing specification. However, the invention which is intended to be protected is not to be construed as limited to the particular embodiments disclosed. These embodiments are to be regarded as illustrative rather than restrictive. Variations and changes may be made by those skilled in the art without departing from the spirit of the present invention.

What is claimed is:

1. A cutting device for continuous material, comprising:

an elongate cutter bar having first and second ends, said cutter bar having a longitudinal axis extending between said ends with first means for receiving a first upright post at the first end of the cutter bar and second means for receiving a second upright post at the second end of the cutter bar so as to extend between said first and second upright posts;

cutting means for cutting the material, said cutting means being rigidly fixed to the cutter bar along a leading edge and extending on one side of said first means;

said first and second means including first and second engagement means respectively for intermittently frictionally engaging the first and second upright posts respectively upon rotation of said elongate cutter bar generally about said longitudinal axis, the first and second engagement means each comprising:

an upstanding projection extending upwardly from a top surface of the cutter bar and extending at least across one side of the respective first means and the second means, said one side being closest to the cutting means and a free edge of each of said projections being angled toward the cutting means; and said cutter bar having a trailing portion extending on another side of said first means and having a lower convex surface adapted to contact the material.

2. The cutting device of claim 1 wherein the cutting means comprises a cutting blade fixed by an adhesive bond in a groove provided in a lower surface of the cutter bar along the leading edge.

3. The cutting device of claim 1 wherein the cutter bar is composed of a single piece of extruded aluminum.

4. The cutting device as in claim 1 wherein the upstanding projections comprise a continuous upstanding rib extending across substantially the entire cutter bar.

5. The cutting device as in claim 1 wherein the first means comprises a first notch provided in the first end of the cutter bar and the second means comprises a second notch provided in the second end of the cutter bar.

6. A cutting device for continuous material, comprising:

an elongate cutter bar having first and second ends, said cutter bar having a longitudinal axis extending between said ends with first means for receiving a first upright post at the first end of the cutter bar and second means for receiving a second upright post at the second end of the cutter bar so as to extend between said first and second upright posts;

cutting means for cutting the material, said cutting means being rigidly fixed to the cutter bar along a leading edge and extending on one side of said first means;

said first and second means including first and second engagement means for intermittently frictionally engaging the first and second upright posts respectively upon rotation of said elongate cutter bar generally about said longitudinal axis; and said cutter bar having a trailing portion extending on another side of said first means and including an upwardly curved channel having a lower convex surface adapted to contact the material.

7. A cutting device for continuous material comprising:

a roll stand having:

a base;

support means for supporting a roll of material, said support means having first and second ends fixed with respect to the base; and first and second upright posts each extending from the base to a position beyond the first and the second ends of the roll respectively, said posts being arranged behind said support means with respect to the direction of rotation of the roll; and an elongate cutter bar including first and second ends, said cutter bar having:

cutting means rigidly fixed to the cutter bar along a leading edge and adapted to contact the periphery of the roll substantially tangentially;

means for positioning the cutter bar between the first and second upright posts whereby the cutter bar can be pivoted about a longitudinal pivot axis extending between said first and second upright posts;

said cutter bar including a trailing portion extending along a trailing edge of the cutter bar and having a lower convex surface adapted to contact said material.

8. A cutting device as in claim 7 wherein the cutter bar further comprises engagement means for frictionally engaging the first and second upright posts when the cutter bar is pivoted.

9. A cutting device as in claim 7 wherein the means for positioning the cutter bar comprises a first and a second notch provided at the first and the second end of the cutter bar respectively, said first and said second notches each having a dimension in a direction perpendicular to the cutting means which is slightly larger than a corresponding dimension of the respective upright post.

10. A cutting device as in claim 9 wherein the upright posts are cylindrical and the diameter of each of said first and second notches is slightly greater than the diameter of the corresponding upright post.

11. A cutting device for continuous material, comprising:

a roll stand having:

a base;

means for supporting a roll of material, said means having first and second ends fixed with respect to the base; and first and second upright posts each extending from the base to a position beyond the first and the second ends of the roll respectively; and an elongate cutter bar including first and second ends, said cutter bar having:

cutting means rigidly fixed to the cutter bar along a leading edge and adapted to contact the periphery of the roll substantially tangentialy;

means for positioning the cutter bar between the first and second upright posts whereby the cutter bar can be pivoted about a longitudinal pivot axis extending between said first and second upright posts said means for receiving the cutter bar comprises a first and a second notch provided at the first and second end of the cutter bar respectively, said first and second notches each having a dimension in a direction perpendicular to the cutting means which is slightly larger than a corresponding dimension of the respective upright post;

said cutter bar including a trailing portion extending along a trailing edge of the cutter bar opposite the cutting blade and including an upwardly curved channel having a lower convex surface adapted to contact said material.

12. A cutting device as in claim 11 wherein the engagement means includes:

an upstanding rib on a top surface of the cutter bar parallel with the cutting blade and extending across substantially the entire length of the cutter bar along a side of the means for receiving the cutter bar closest to the cutting blade.

13. A cutting device as in claim 12 wherein the edge of the means for receiving the cutter bar nearest the curved channel frictionally engages the first and the second upright posts when the cutter bar is pivoted.

14. A cutting device for continuous material wound on a roll, comprising:

a one piece elongated cutter bar defining leading and trailing longitudinal edges with a first notch provided at a first end of said cutter bar and a second notch provided at a second end of said cutter bar, each of said notches being generally U-shaped with front and back edges with an integral upstanding rib intersecting said front edges of said notches and extending continuously from said first end to said second end, said cutter bar having an integral, upwardly curved channel disposed behind said first and second notches to define the trailing edge for said cutter bar; and a cutter blade mounted on the leading edge of the cutter bar ahead of said notches and said upstanding rib.

15. A cutting device for material wound on a roll, comprising:

a roll stand having:

a base;

a roll support rod mounted on the base; and first and second parallel posts extending upwardly with respect to the base, said posts being arranged behind said roll support rod;

a one piece elongate cutter bar having:

a first notch and a second notch provided respectively at a first end and a second end of the cutter bar, said first and second notches slidably receiving said first and second posts with a rear edge of each notch frictionally engaging a rear surface of the respective post upon a pivoting of said cutter bar;

an upstanding rib provided immediately ahead of said first and second notches with said upstanding rib frictionally engaging a front surface of said first and second posts upon said pivoting of said cutter bar;

an upwardly curved channel disposed behind said first and second notches to define a trailing edge of the cutter bar, said channel being arranged to engage an outermost layer of the material with said channel urged against said material upon said pivoting of the cutter bar to prevent rotation of the roll; and a cutter blade mounted on the cutter bar to define a leading edge thereof, said cutter blade being positioned in front of the first and second notches and the upstanding rib.

16. The cutting device of claim 15 wherein said cutter blade is arranged generally in a horizontal plane and tangential with respect to the roll.

17. A cutting device comprising:

an elongate cutter bar having first and second ends, said cutter bar having a longitudinal pivot axis extending between said ends;

first means for receiving a first upright post in the first end of the cutter bar and second means for receiving a second upright post at the second end of the cutter bar;

cutting means for cutting continuous material, said cutting means being fixed to the cutter bar along a leading edge;

said first means including first engagement means for intermittently frictionally engaging the first upright post upon rotation of said elongate cutter bar generally about said longitudinal axis; and an upwardly curved channel provided along an edge opposite the cutting means.

18. A cutting device comprising:

an elongate cutter bar having first and second ends, said cutter bar having a longitudinal pivot axis extending between said ends;

first means for receiving a first upright post in the first end of the cutter bar and second means for receiving a second upright post at the second end of the cutter bar;

cutting means for cutting continuous material, said cutting means being fixed to the cutter bar along a leading edge;

said first means including first engagement means for intermittently frictionally engaging the first upright post upon rotation of said elongate cutter bar generally about said longitudinal axis, and said second means including second engagement means for intermittently frictionally engaging the second upright post upon said rotation of said elongate cutter bar, the first and second engagement means together comprising:

an upstanding projection extending along a top surface of the cutter bar and extending across one side of both the first means and the second means, said one side being closest to the cutting means, said upstanding projection comprises a continuous upstanding rib extending across substantially the entire cutter bar with a free edge of the rib being angled toward the cutting means.

* * * * *